US005573394A

United States Patent [19]

Pershina

[11] Patent Number: 5,573,394

[45] Date of Patent: Nov. 12, 1996

[54] LOW PROFILE BURNER ASSEMBLY

[76] Inventor: John C. Pershina, 2124 Freeland Rd., Freeland, Md. 21053

[21] Appl. No.: 327,264

[22] Filed: Oct. 21, 1994

[51] Int. Cl.[6] ..... F23Q 7/06

[52] U.S. Cl. ..... 431/258; 431/349; 431/125; 126/271.1

[58] Field of Search ..... 431/258, 349, 431/125; 126/271.1, 271.2, 271.4

[56] References Cited

U.S. PATENT DOCUMENTS

| | | | |
|---|---|---|---|
| 3,685,977 | 8/1972 | Goodman | 431/258 X |
| 4,466,789 | 8/1984 | Riehl | 431/258 X |
| 4,547,152 | 10/1985 | Svendsen | 126/271.1 X |
| 4,962,750 | 10/1990 | Bridgewater | 431/125 X |
| 5,114,336 | 5/1992 | Karabin et al. | 431/125 |
| 5,263,852 | 11/1993 | Beck | 431/125 |
| 5,320,520 | 6/1994 | Barth et al. | 431/125 |
| 5,328,356 | 7/1994 | Hawkinson | 431/125 |
| 5,399,084 | 3/1995 | McCullough et al. | 431/125 |

*Primary Examiner*—Larry Jones

*Attorney, Agent, or Firm*—Venable, Baetjer, Howard & Civiletti, LLP

[57] ABSTRACT

A low-profile burner assembly (LPBA) with pilot for creating realistic firefighter training fires in a controlled setting. The LPBA generally includes a sealed pipe fitting shell with a fuel inlet for inputting combustible fuel, an air inlet for inputting air to be mixed with the fuel, a spark ignition system coupled to the pipe fitting shell for igniting a pilot flame, and a main burner outlet for outputting a combusting air/fuel mixture to create a firefighting training flame. Fuel is distributed within the pipe fitting by an internal distribution tube for metering pilot and main burner portions, and for proper mixing with air. In addition, a sensor probe assembly is provided for monitoring the LPBA. All internal components are well-protected from the high-pressure spray of extinguishing agents by a transport/deflector assembly.

18 Claims, 8 Drawing Sheets

LOW PROFILE BURNER ASSEMBLY

FIELD OF THE INVENTION

The present invention relates to fire extinguishment training devices and, more particularly, to a low profile burner assembly for generating a training flame.

BACKGROUND OF THE INVENTION

Live fire training is an important part of any firefighting training curriculum. Unfortunately, a number of factors have made conventional live fire training methods unacceptable. For instance, the personal safety of the trainee is compromised. Many firefighters have sustained serious injuries during training fires conducted with abandoned structures. The burning of such structures create fires that are unpredictable and uncontrollable. Moreover, there are serious environmental problems. Live fire training on abandoned structures results in significant air pollution. In fact, many conventional live fire methods have been condemned by government and environmental agencies. In any case, the supply of abandoned structures available to burn for live fire training is fast diminishing because the demand for live fire training is increasing. Firefighters at all levels of experience need access to repeated training situations to keep their skills sharp.

Fortunately, a more effective live fire training concept has been developed. Gas burners are being used to create a vigorous yellow burning flame. The resulting flame is highly controllable, easily monitored, environmentally correct and easy to reproduce. The controlled burner concept is gaining recognition by the Fire Service as a safe, effective training tool, and the U.S. Navy has installed a number of controlled burner systems for shipboard firefighting training. A handful of municipalities have installed similar burners in their existing burn buildings. These systems utilize natural gas or propane in liquid (LPG) or gaseous states as the source of fuel. The fuel is released into the burner at low pressure and is ignited by inextinguishable pilot heads. The size of the resulting flame is controlled by monitoring valves which regulate the gas flow into the training environment.

A primary problem with controlled burner assemblies for fire training is the incursion of extinguishment agents into sensitive areas of the burner. For instance, if the extinguishing agent reaches the pilot, the unit's reliability or operation will be compromised. One of the main ways that agents such as water cause problems is from unwanted reflection from surrounding surfaces. Larger burner assemblies are attacked with high pressure fire houses in lieu of portable extinguishers, and the reflections can be secondary or even tertiary in nature. The need for reliable performance dictates that these reflections be prevented from reaching the burner pilot.

SUMMARY OF THE INVENTION

It is an object of the invention to provide an improved burner assembly with pilot for creating realistic firefighter training fires in a controlled setting.

It is another object to provide a compact and extremely low profile burner assembly with pilot that is unobtrusive and easily transported.

It is another object to provide a combusting chamber in which fuel is distributed in a metered fashion for mixing with air and for igniting a pilot flame.

It is still another object to create a more reliable burner assembly in which the pilot and other internal components are well-protected from the high-pressure spray of extinguishing agents.

It is a further object of the invention to provide a burner assembly having a spark-plug ignition system which is sealed from chemical corrosives.

In accordance with these and other objects, the present invention provides a low profile burner assembly (LPBA) with pilot for automatically generating a flame suited for live fire fighting training. The LPBA generally includes a sealed shell formed from pipe fittings and defining a chamber. The chamber has a fuel inlet for inputting combustible fuel, an air inlet for inputting pilot air and pilot flame propagation air, a first port and opposing second port, and a main burner outlet for outputting an air/fuel mixture for combustion. An ignition assembly is coupled into the first port of the chamber. The ignition assembly includes a spark plug with a spark gap section protruding into the chamber of the pipe fitting shell. The ignition assembly is itself enclosed within a protective pipe fitting shell.

In addition, an optical probe assembly is provided for monitoring the LPBA. The optical probe assembly includes an optical sensor element protruding into the chamber of the pipe fitting shell through the second port (preferably facing said spark gap directly).

Fuel enters the fuel input port of the pipe fitting shell via a fuel distribution tube. The fuel distribution tube extends interiorly through the pipe fitting shell for distributing fuel inside the chamber. The fuel distribution tube has a pilot orifice along its length near the spark gap for flowing a pilot portion of the fuel to the spark gap. In addition, the distribution tube has at least one main burner outlet along its length and upstream of the spark gap for outputting the balance of the fuel.

The pilot portion of fuel is ignited by the spark plug to maintain a pilot flame for igniting and combusting the balance of the fuel.

A flame deflector/transport assembly is supported over the main burner outlet of the chamber, and the deflector/transport assembly has a chimney to pass the combusting fuel. The deflector/transport assembly shields the main burner outlet to protect the pilot flame and internal components.

In addition, a flame transport assembly is supported over the chimney for channeling the combusting fuel into a plume-shaped flame.

Other advantages and results of the invention are apparent from a following detailed description by way of example of the invention and from the accompanying drawings.

DETAILED DESCRIPTION OF THE PREFERRED EMBODIMENT

Figure 1:
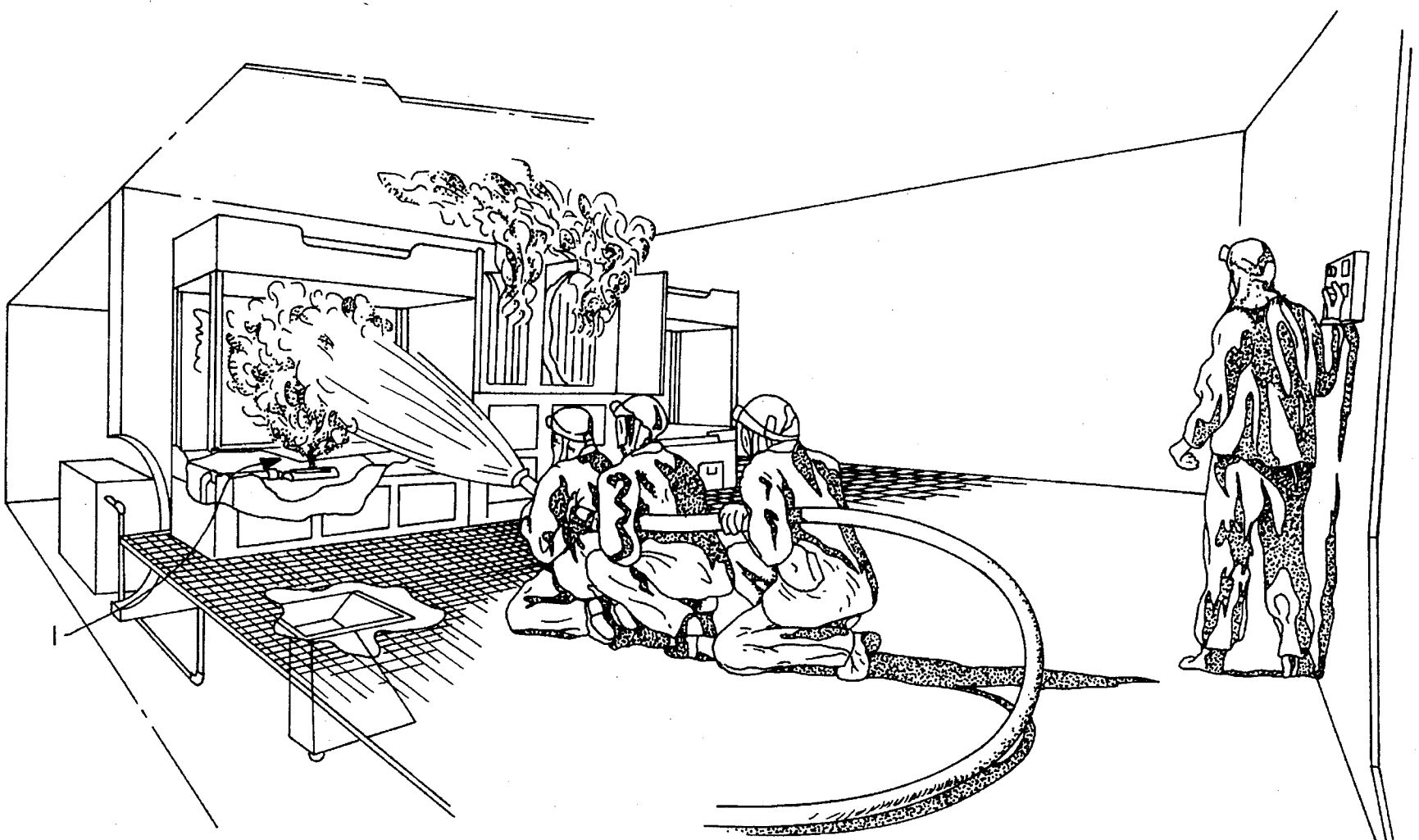
FIG. 1 is a perspective drawing of a Low Profile Pilot Burner (LPBA) system 1 being used in accordance with the present invention.

As shown in FIG. 1, the Low Profile Pilot Burner (LPBA) 1 according to the present invention is a highly compact unit that is capable of creating the desirable yellow orange training flame that is suited for live fire extinguishment training. The LPBA is capable of maintaining a safe pilot flame and a vigorous main flame even when massive amounts of extinguishing agents are applied and the surrounding air supply becomes diminished. The LPBA may be used in a variety of mock-ups, including an electronics cabinet fireplace and deep fat fryer.

Figure 2:
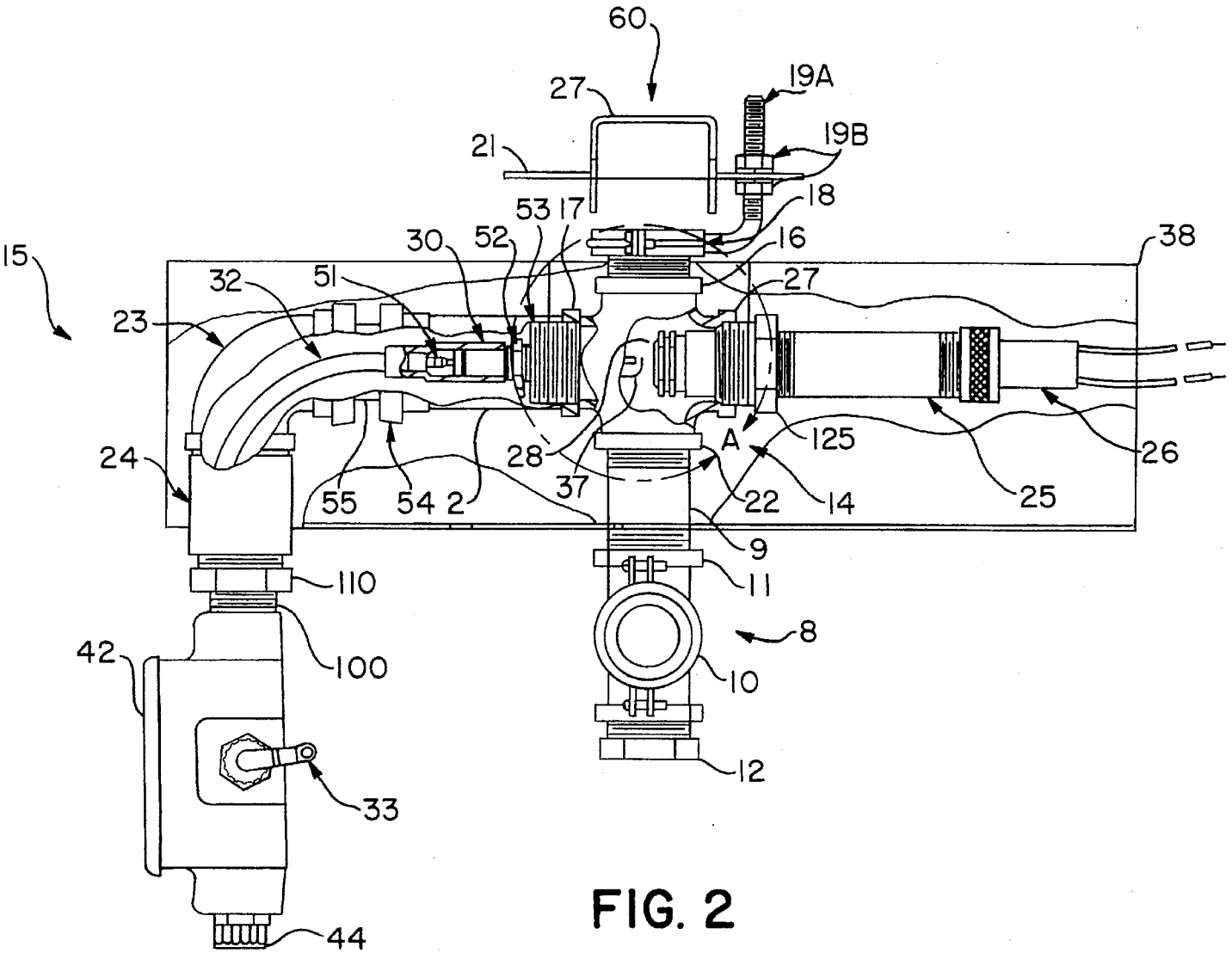
FIG. 2 is a more detailed perspective drawing of an LPBA 1 according to the present invention.

FIG. 2 is a more detailed illustration of an LPBA 1 according to the present invention. The LPBA 1 includes a Lower T section 8 with two inlets 10 and 12 for inputting the air and fuel supplies, respectively, and an outlet 11. The air enters at air inlet 10. Preferably, the air supply is controlled prior to entering the Lower T section 8 by a conventional upstream gauge valve or other suitable device (not shown). Any suitable manual or automatic flow control valve certified to be used with the respective gas or air may be used, and this includes gates, balls, butterfly valves, etc. A similarly controlled fuel supply is fed up through the bottom of the Lower T section 8 at fuel inlet 12. Both the fuel inlet 12 and air inlet 10 are preferably equipped with conventional threaded compression fittings, C-clamp fittings, or other suitable means for sealed attachment to the respective air and fuel supply lines.

A standard connecting pipe fitting 9 connects the outlet 11 of the lower T section 8 to an inlet port 22 of a main cross-section 14. The main cross-section 14 serves as a juncture between the lower T section 8, an ignition system 15, and an optical sensor 26.

The ignition system 15 is coupled to the main cross-section 14 by a section of standard pipe fitting 2 which mates with the main cross-section 14 at a port 17 adjacent the lower port 22. Pipe fitting section 2 houses an interior spark plug 30. Spark plug 30 may be any conventional spark plug subject to size and voltage limitations. For example, an Auburn™ I-25 is well-suited.

A spark gap portion 37 of the spark plug 30 extends from pipe fitting section 2 toward the center of the main cross-section 14. The spark plug leads are preferably encased in a high voltage silicone cable 32 which runs through further pipe fitting sections 23 and 24 to a conduit interface box 42.

Figure 3:
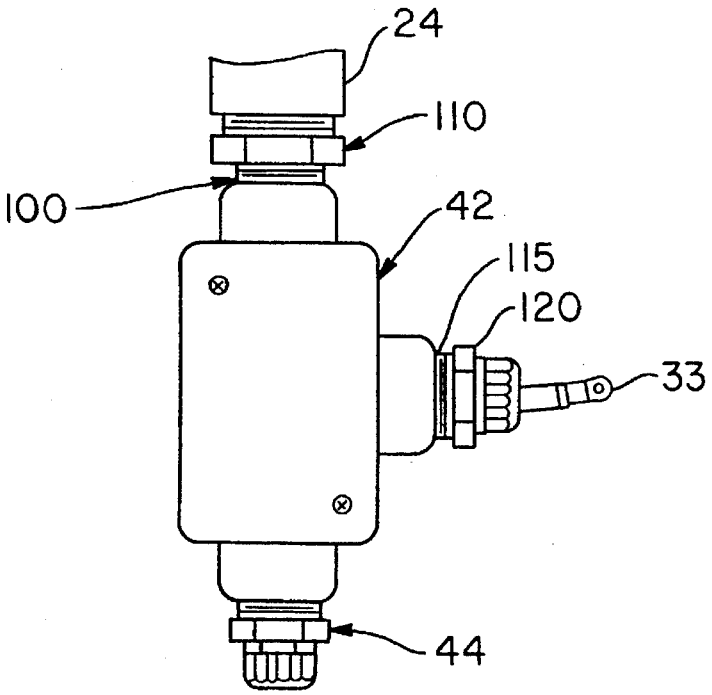
FIG. 3 is an enlarged drawing of the conduit interface box 42 of FIG. 2

FIG. 3 is a more detailed illustration of the conduit interface box 42. The conduit interface box 42 provides a juncture and storage area for a length of slack high voltage cable 32. The additional length of cable 32 facilitates maintenance and inspection of the spark plug 30. The conduit interface box 42 is coupled by internally-threaded pipe fitting section 24 to an externally-threaded bushing 110, which in turn screws onto a threaded nipple 100 which protrudes from conduit interface box 42. Inside conduit interface box 42, the spark plug leads run to a conventional wire lug 33 that protrudes from the side of conduit interface box 42. The wire lug 33 is likewise secured to the conduit interface box 42 by a bushing 120 that screws onto a threaded nipple 115 protruding from conduit interface box 42.

A high voltage transformer can be connected to the wire lug 33 to perform ignition, and a variety of suitable transformers are available commercially for that purpose.

In many training situations and especially where purple potassium powder (PKP) extinguishers are employed, the extinguishing agent has a conductive nature that presents both short and long term maintenance problems to the high voltage circuitry of the burner pilot assembly. To prevent spark plug, boot, or wire contamination, all of the above described pipe fitting and housing sections of the low profile burner establish an excellent chemical shield. All pipe fittings and conduit interface box 42 are preferably galvanized or stainless steel. In addition, the connection of the high voltage silicone cable 32 to the spark plug 30 is preferably covered by a conventional spark plug boot, and both boot and cable are high-temperature non-conductive material.

Moreover, the entire pipe fitting shell enclosing the ignition system 15 preferably employs metal-to-metal sealed couplings which may be compression fittings or threaded fittings treated with "pipe dope", e.g., commercially available thread dressing. The threaded fitting will provide a continuous shield containment shell that prevents contamination. Compression style rigid fittings may be used in order to provide quick access for any maintenance activities that might arise. In the illustrated embodiment, the spark plug 30 is mounted into port 17 of the T-section 14 using a flush reducing bushing 53. As can be seen in FIG. 2, the flush reducing bushing 53 is a hollow cylindrical metallic member having threads formed along the full interior and exterior length. The spark plug 30 has a conventional threaded base 52 which screws into the flush reducing bushing 53. The spark plug 30 is screwed in until tight, whereupon the spark gap portion 37 protrudes from one end of bushing 53 and the leads protrude from the other end. The entire spark plug 30 and bushing 53 assembly is then screwed into port 17 of the T-section 14 until approximately one-half of the threads of the bushing 53 are consumed in the T-section. The angular orientation of the spark gap 37 of spark plug 30 is set exactly as shown in FIG. 2. While the spark plug 30 is held against further rotation, conduit coupling 2 is inserted over the leads of spark plug 30 and is threaded onto the exposed threads of the flush reducing bushing 53. Conduit coupling 2 is a standard length of conduit having interior threads. The conduit coupling 2 is threaded onto bushing 53 until it abuts T-section 14. By tightening the coupling section 2 against the T-section 14, all of the associated parts are prevented from rotating. The spark plug 30 is locked in position and is fully protected. A length of threadless conduit 55 is then inserted in a conduit compression fitting 54, and compression fitting 54 is threaded into the coupling section 2. The conduit compression fitting 54 includes a conventional internal split ring that is squeezed down onto the threadless conduit 55 as compression fitting 54 is tightened.

Again, all of the engaging threads described above are preferably coated with "pipe dope" or thread dressing that fills all metal-to-metal voids and eliminates the incursion of extinguishing agents.

Referring back to FIG. 2, the optical sensor 26 may be a conventional ultraviolet sensor, and it is coupled into the main cross section 14 by an externally threaded sleeve 25 that screws into an internally-threaded bushing 125, which in turn screws into a port 27 that is diametrically opposite ignition system 15. A sensing element of optical sensor 26 is directed toward the spark gap portion 37 of plug 30, and it faces spark gap portion 37 through a protective face plate 28. The optical sensor 26 converts ultraviolet light from the spark gap 37 into electrical current to allow verification of spark operation.

Figure 4:
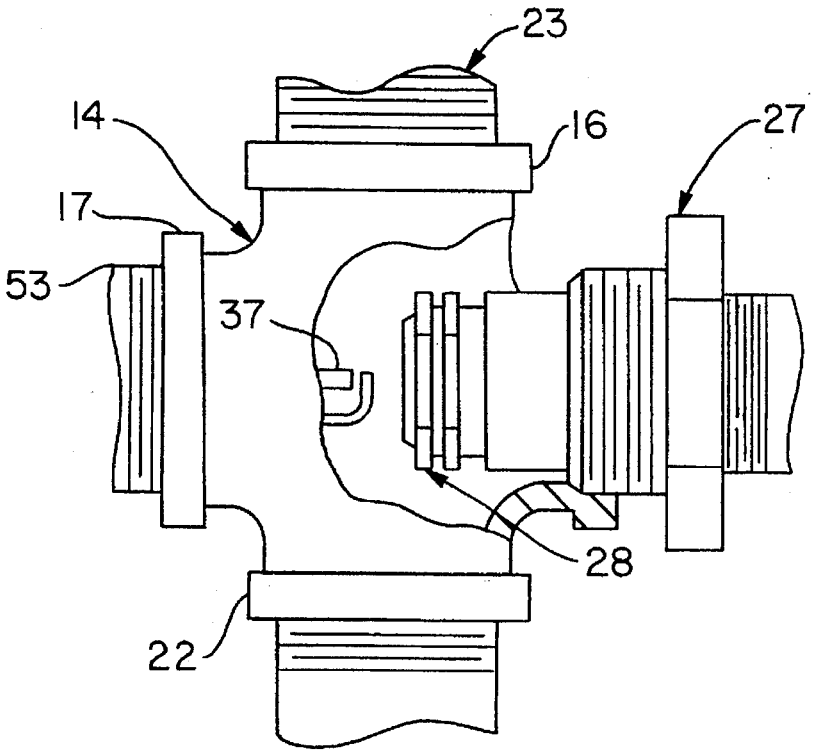
FIG. 4 is an exploded cut-away view of the main cross section 14 of the LPBA 1 of FIG. 2.

FIG. 4 shows an exploded cut-away view of the juncture within the main cross section 14 of ignition system 15 and the face plate 28 of optical sensor 26. Preferably, the sensing element and face plate 28 are close but slightly spaced from the spark gap portion 37 of the spark plug 30. It is important that no contact is made.

In operation, fuel enters the lower T section 8 through fuel inlet 12, and air is input through air inlet 10. The internal apportioning and routing of the air/fuel mixture is accomplished with an internal "S" tube fuel distribution system. The origin of the S-tube is shown more clearly in FIG. 5, which is a cut-away view of the lower T section 8 taken along the lines C—C' of FIG. 2. The lower end of the S Tube 1 is connected by a conventional flare fitting including a flare nut 45 which is coupled to a flare pipe 145, which is in turn threaded onto a bushing 147. The bushing 147 is seated in fuel inlet port 47 which screws into the lower cross-section 8. The S Tube extends upwardly through the Lower T section 8 and into the main cross section 14.

Figure 6:
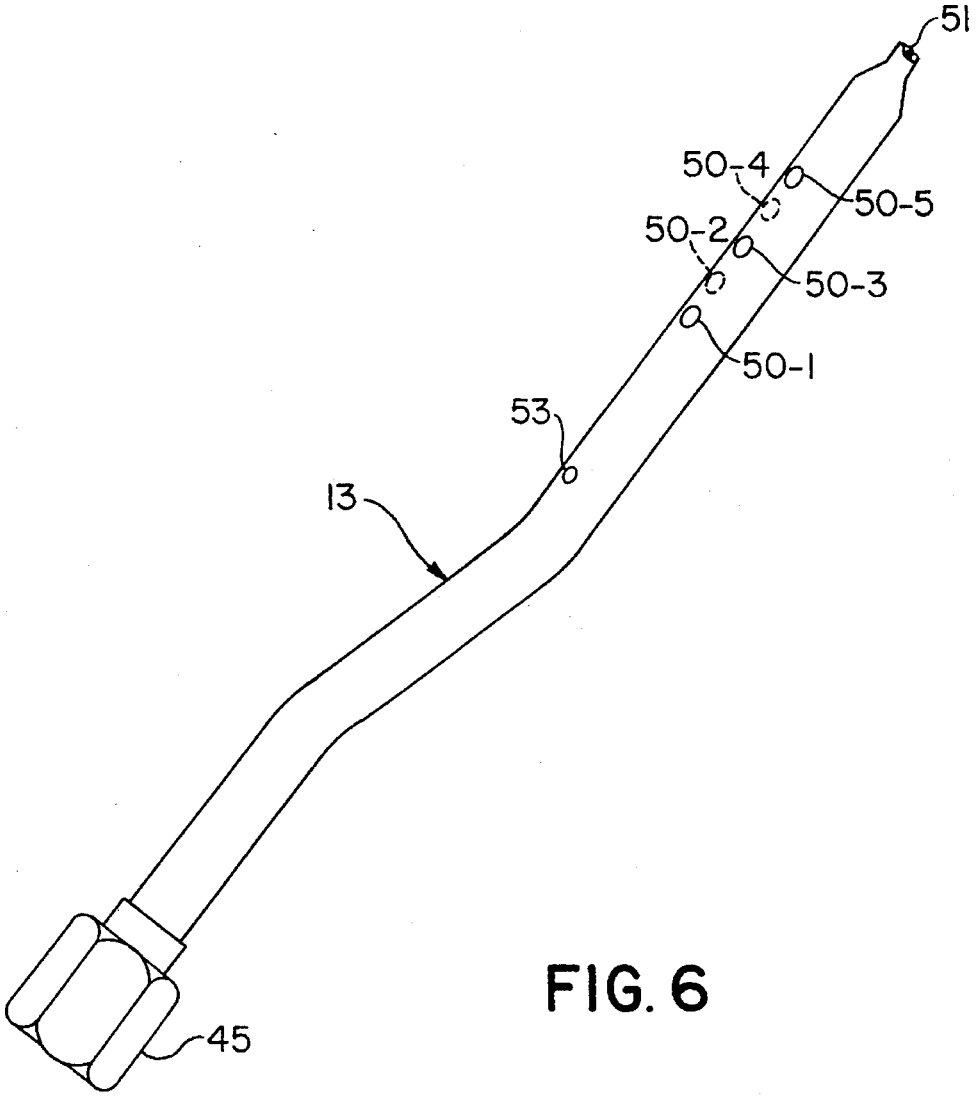
FIG. 6 is an isolated and exploded view of an exemplary S Tube 13 as in FIG. 5.

FIG. 6 is an isolated and exploded view of an exemplary S Tube 13 for distributing the main burner fuel and pilot fuel upwardly within the LPBA system 1. The lower end of the S Tube 1 comprises a flare nut 45 which mates with flare pipe 145. Beginning at flare nut 45, the S-tube 13 extends a short distance to an offset portion. The offset portion of the S-tube 13 continues to extend to a crimped outlet 51. The S tube 13 transfers the combustion fuel to various locations inside the LPBA and meters the proper amount of fuel for maintaining the pilot flame and for the main flame. Crimped outlet 51 can serve as one outlet for the main burner fuel. A series of intermediate perforations 50-1 . . . n also release main burner fuel along the upper length of the S tube 13. In the illustrated embodiment, there are five intermediate perforations 50-1 . . . 5, and these are alternately positioned on opposing sides of the S-tube 13 to better distribute the fuel. A small portion of pilot fuel is released through a smaller pilot perforation 53. By distributing the fuel within the LPBA system this way, the fuel and air remain isolated within the pipe fitting channel, the fuel is properly apportioned for the two flames (main and pilot), and the proper fuel air ratios can be kept.

Figure 7:
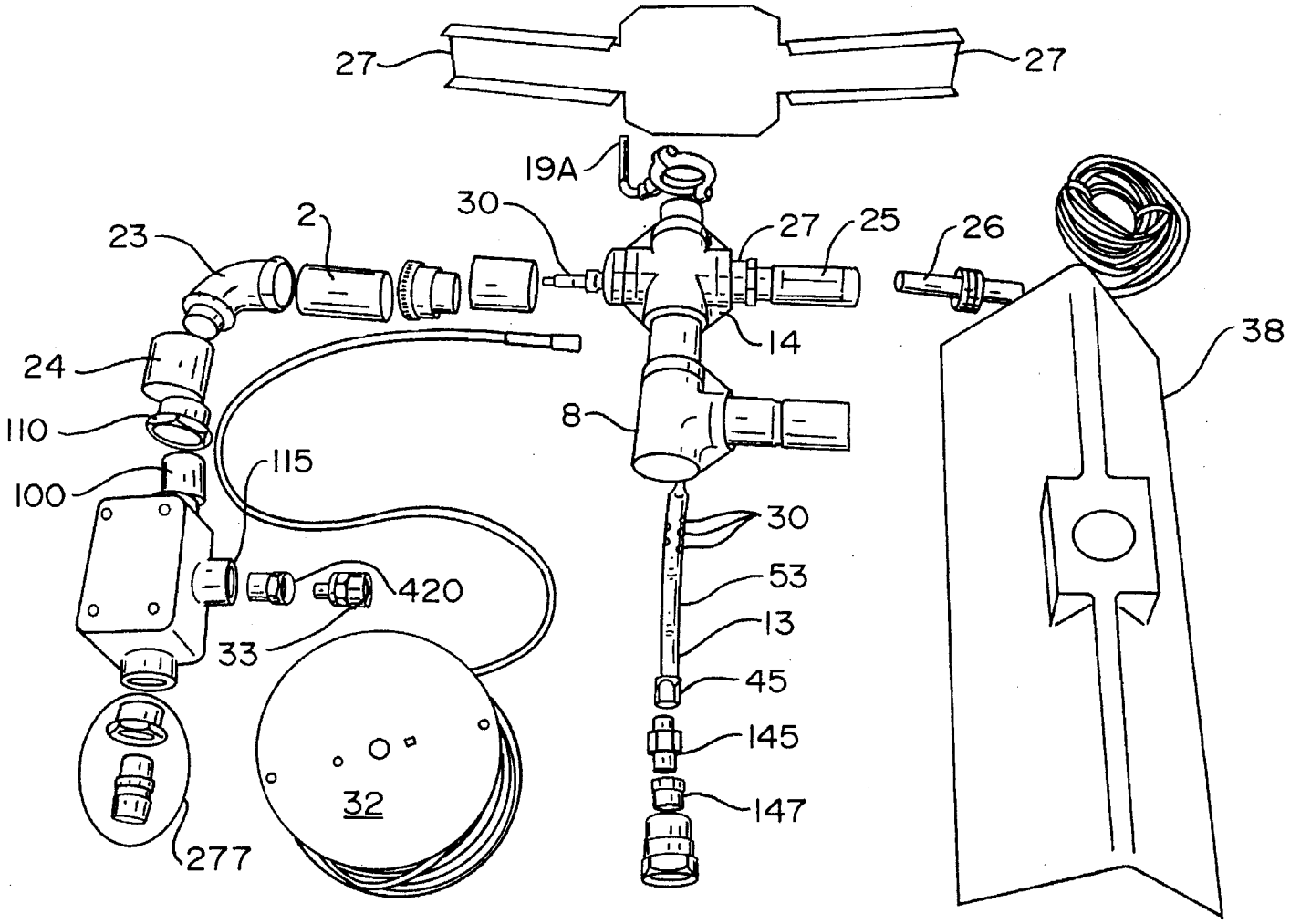
FIG. 7 is an exploded assembly diagram of the LPBA 1 showing the insertion of the S Tube 13 of FIG. 6 through the main cross-section 14.

FIG. 7 is an exploded assembly diagram of the LPBA 1 showing the insertion of the S Tube 13 of FIG. 6. When fully inserted, the S-tube 13 extends upward out of the lower T-section 8 and through the main cross-section 14.

In operation, the pilot portion of fuel is released from the S Tube 13 and mixes with air directly in front of the spark gap 37 of spark plug 3. The spark gap 37 serves as the initial ignition source. The pilot fuel is sprayed across the spark gap and generates a hot blue pilot flame that maintains the spark plug 30 in a carbon free state. This duel pilot condition (spark and flame) is an important feature of the LPBA unit 1.

Figure 8:
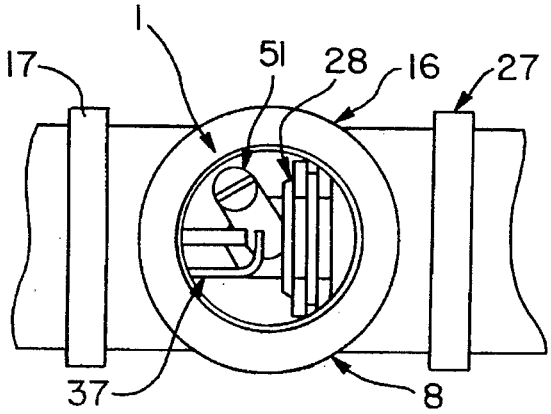
FIG. 8 is a partial top cut-away view looking down into port 16 of the main cross section 14 of FIG. 4.

FIG. 8 is a top cut-away-view looking down into port 16 of the main cross section 14. The spark gap 37 of spark plug 30 extends into the Lower T section 8 sideways through port 17, and the optical sensor of optical probe 25 extends sideways into the opposing port 27 of the main cross section 14. The S Tube 13 extends concentrically upward within the sleeve of the Lower T section 8, through the connecting nipple 9, and toward the spark gap 37 (positioned centrally within the main cross section 14). Just prior to the spark gap 37, the S Tube 13 is offset to the side of the main cross section 8 (around the side of spark gap 37). The pilot fuel outlet 53 faces spark gap 37 and releases a measured amount of pilot fuel directly toward spark gap 37. When ignited by spark gap 37, the pilot flame travels upward inside the main cross section 14 and is exhausted through LPBA outlet tube 23. The internal S Tube 13 isolates the balance of the combustion fuel from the escaping pilot flame, for the main burner fuel continues up the S Tube and is released later. The offset portion of the S Tube 13 continues upward along the interior wall of the main cross section 14 to the crimped main burner fuel outlet 51. The series of intermediate main burner fuel outlets 50-1 . . . 5 release the main burner fuel at intervals for proper mixture with the air, and the mixture is released through the upper port 16 of the upper cross section 14. The pilot flame, all noncombusted air and fuel, and the escaping main flame fuel are ejected from the top of the LPBA system 1 into a Flame Deflector/Transport assembly 60. The Flame Deflector/Transport assembly 60 is secured to the top of the outlet pipe 23 by conventional pipe clamp 18 or the like.

Figure 5:
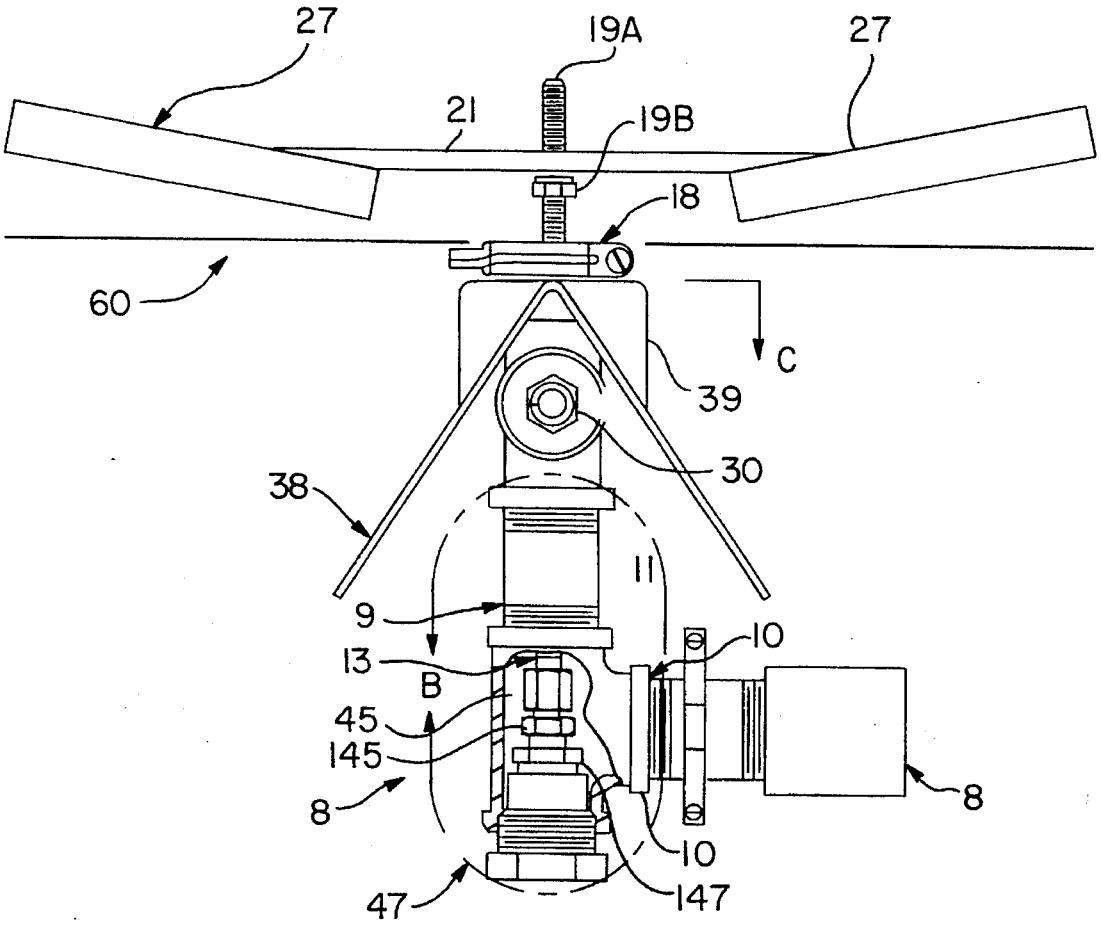
FIG. 5 is a cut-away view of the lower T section 8 taken along the lines C—C' of FIG. 2.

As seen in FIGS. 2 and 5, the flame deflector/transport assembly 60 further comprises an elongate angled deflector 38 having a "V"-shaped cross-section, and a chimney section 39 which is constricted to form a sleeve that fits around the outside of the outlet tube 23.

Figure 9:
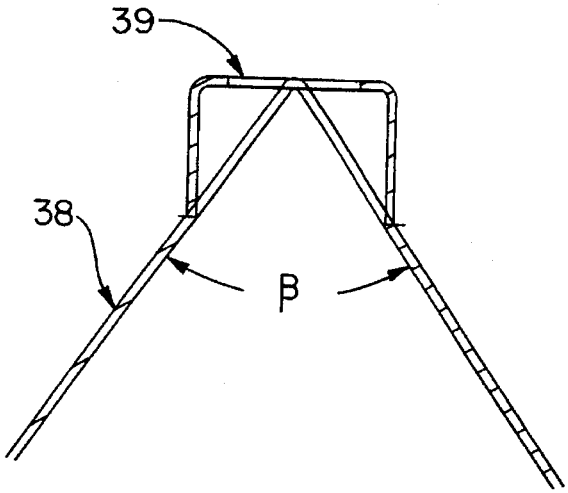
FIG. 9 is an isolated side cross-section of the deflector 38 with chimney section 39 of FIGS. 2 and 5.

FIG. 9 is an isolated side cross-section of the deflector 38 with chimney section 39. The angle β is the minimum necessary to clear T-section 14. A steeper exterior slope helps to reduce reflections of water and other extinguishing agents.

Figure 10:
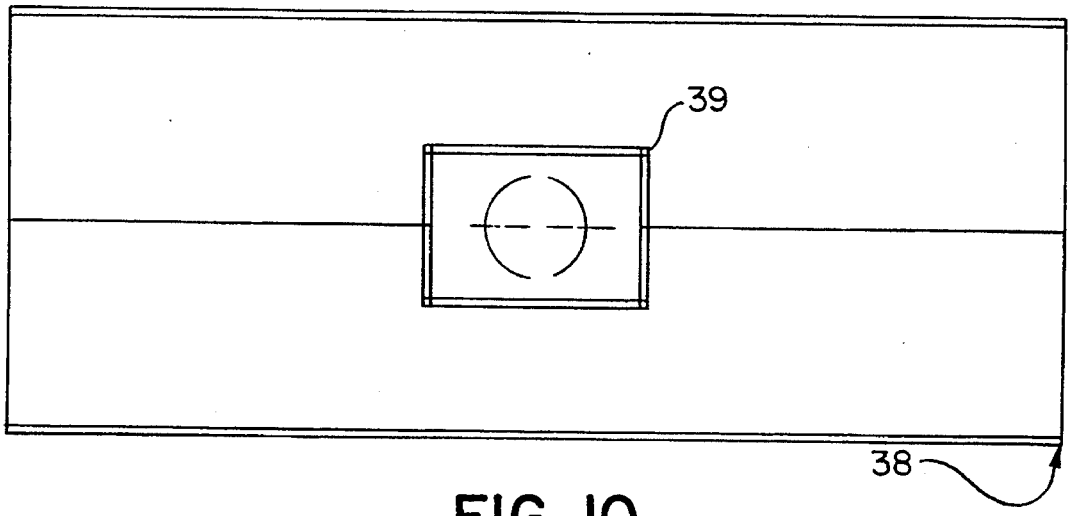
FIG. 10 is a top view of the deflector 38 of FIG. 9 looking into central chimney section 39.

FIG. 10 is a top view of the deflector 38 looking into central chimney section 39.

Figure 11:
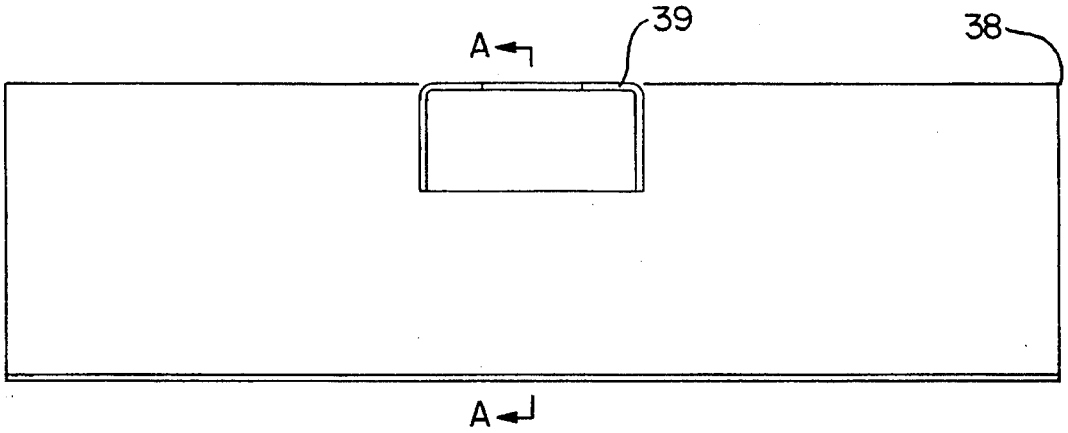
FIG. 11 is a side view of the deflector 38 of FIG. 9.

FIG. 11 is a side view of the deflector 38 showing side cut-outs for central chimney section 39.

One of the primary problems with fire trainers is the incursion of extinguishing agents to areas of the burner pilot where they degrade the reliability or operation of the unit. For example, one of the main ways that water causes such problems is from unwanted reflection from the surrounding surface. Since larger fireplaces are often attacked with high pressure fire hoses rather than portable extinguishers, reflections can be secondary or tertiary in nature. The narrow silhouette inverted V-shaped angled deflector prevents these reflections from reaching the low profile burner pilot. This deflector 38 permits a high bypass of applied agent to occur. The deflector 38 also serves as a thermal barrier against radiant heat and flame infringement resulting from extinguishment agent induced flame downdrafts. The shield utilizes a single burner attach point (chimney 39) and does not require fireplace mark-up connections. The narrow profile of deflector 38 allows agents to rapidly reach the respective detectors. This permits optimal response to trainee activities.

Referring back to FIG. 5, the pipe clamp 18 constricts the sleeve of chimney 39 against the outlet tube 23. Support rod 19 protrudes laterally from a side of the pipe clamp 18 and elbows upward by a short length.

Figure 12:
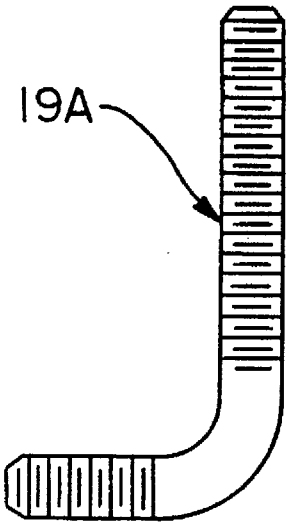
FIG. 12 is an isolated side view of the threaded support rod 19.

FIG. 12 is an isolated side view of the threaded support rod 19.

With reference to FIGS. 2 and 5, the support rod 19 secures a horizontal deflector/central plate 21 which extends laterally outward and itself supports a pair of divergent flame spreaders 27.

The Deflector/Central Plate 21 extends outward from the LPBA 1 to prevent reflection angles from directing agents into the primary burner outlet tube 23. The V-shaped deflector 38 contributes to the simplicity of the Central Plate 21. Attached on both sides of the Central Plate 21 are flame transport channels 27. These channels 27 have inverted generally "U"-shaped cross sections to channel a portion of the flame, and also to provide a shield against extinguishment agent. Flame spreaders 27 channel the burner flame upwardly and outward. The deflector/central plate 21 makes the plume shaped flame which is characteristic of training flames. The flame spreaders 27 allow most flame to travel toward the primary training area while ducting a sufficient quantity of flame into a region where secondary burner combustion fuel can be fed for ignition. This allows one LPBA to be used as an ignition source for another burner, thereby eliminating the need for another ignition assembly 15.

To capitalize on the tendency of hot air to rise, the spreaders 27 are set at a slight incline from the horizontal plane of the Central Plate 21. This incline results in a chimney effect permitting a flame to be ejected from the end of the spreaders 27. To ensure the transported flame is not disturbed by extinguishment agents, reflection angles of surrounding structures must be considered. The flames ejected from the spreaders 27 could be susceptible to normal agent deflections and must be emitted into a guarded pilot location. The general overall structure must absorb tremendous amounts of heat. Therefore, the spreaders 27 require reinforcing gussets to prevent heat as well as high pressure extinguishment agents from changing the angle of the incline.

Having now fully set forth a detailed example and certain modifications incorporating the concept underlying the present invention, various other modifications will obviously occur to those skilled in the art upon becoming familiar with said underlying concept. It is to be understood, therefore, that within the scope of the appended claims, the invention may be practiced otherwise than as specifically set forth herein.

I claim:

1. A fuel burner with pilot assembly for automatically generating a flame suited for live fire fighting training, the fuel burner assembly comprising:

a pipe fitting shell defining a chamber and having a fuel inlet to said chamber for inputting combustible fuel, an air inlet to said chamber for inputting air to be mixed with said fuel prior to ignition, a first port and an opposing second port, and a main burner outlet from said chamber for outputting an air/fuel mixture for combustion;

an ignition assembly including a spark plug with a spark gap section protruding into the chamber of said pipe fitting shell through said first port;

an optical probe assembly having an optical sensor element protruding into the chamber of said pipe fitting shell through said second port facing said spark gap;

a fuel distribution tube connected to the fuel inlet of said pipe fitting shell and extending interiorly therethrough for distributing said fuel within said chamber, said distribution tube having a pilot orifice along its length near said spark gap for flowing a pilot portion of said fuel to said spark gap, and said distribution tube having at least one main burner outlet along its length and downstream of said spark gap for outputting a balance of the fuel, whereby the pilot portion of fuel is to maintain a pilot flame for igniting and combusting the balance of said fuel;

a deflector/transport assembly supported over the main burner outlet of said chamber and having a chimney to pass the combusting fuel, said deflector/transport assembly otherwise shielding said main burner outlet to protect the pilot flame; and a flame spreader assembly supported over the chimney of said deflector/transport assembly for channeling the combusting fuel passing therethrough into a flame.

2. The pilot/burner assembly according to claim 1, wherein the pipe fitting shell further comprises a first section having the fuel inlet and air inlet, and a second section coupled to said first section, said second section having an inlet, a first port and opposing second port, and a main burner outlet.

3. The pilot/burner assembly according to claim 1, wherein the spark plug is connected by a pair of leads encased in a high voltage cable, and a third section of the pipe fitting shell encases said high voltage cable.

4. The pilot/burner assembly according to claim 3, wherein the third section of pipe fitting shell encasing said high voltage cable is impervious to chemical agents.

5. The pilot/burner assembly according to claim 1, wherein the optical sensor further comprises an ultraviolet sensor having a sensing element directed to the spark gap of the spark plug.

6. The pilot/burner assembly according to claim 1, wherein the fuel distribution tube further comprises a tube having an offset portion extending upward and around the spark gap.

7. The pilot/burner assembly according to claim 6 wherein the fuel distribution tube further comprises a pilot orifice in said offset portion and aligned with the spark gap, and at least one main burner fuel outlet downstream of said pilot orifice.

8. The pilot/burner assembly according to claim 7, wherein the fuel distribution tube further comprises a series of main burner fuel outlets spaced along the offset portion of said tube.

9. The pilot/burner assembly according to claim 1, wherein the deflector/transport assembly comprises an elongated hood having a V shape cross-section for protecting the pilot flame.

10. The pilot/burner assembly according to claim 9, wherein the chimney of said hood further comprises a central opening positioned over the outlet of said pipe fitting shell for venting combusting fuel.

11. The pilot/burner assembly according to claim 10, further comprising a support rod connected to said chimney by a retaining mechanism.

12. The pilot/burner assembly according to claim 11, whereby said flame spreader assembly is supported over the deflector/transport assembly by the support rod.

13. The pilot/burner assembly according to claim 11, wherein the flame spreader assembly further comprises a central plate supported by said support rod, and a pair of flame spreaders each attached at an opposing end of said central plate to direct the combusting fuel into a flame of particular shape.

14. The pilot/burner assembly according to claim 13, wherein said pair of flame spreaders each further comprise an inverted trough angled upward and outward from the pipe fitting shell for channeling said combusting fuel.

15. The pilot/burner assembly according to claim 13, wherein said pair of flame spreaders are adjustable for channeling the combusting fuel passing therethrough into a flame of selectable shape.

16. A burner assembly for generating a flame, comprising:

a chamber having a fuel inlet for inputting combustible fuel, an air inlet for inputting air to be mixed with said fuel prior to ignition, a first port, and a main burner outlet from said chamber for outputting an air/fuel mixture for combustion;

an ignition assembly including a spark plug with a spark gap section protruding into the chamber through said first port;

a fuel distribution tube connected to the fuel inlet of said chamber and extending interiorly therein for distributing said fuel within said chamber, said distribution tube having a pilot orifice along its length near said spark gap for flowing a pilot portion of said fuel to said spark gap, and said distribution tube having at least one main burner outlet along its length and downstream of said spark gap for outputting a balance of the fuel, whereby the pilot portion of fuel is to maintain a pilot flame for igniting and combusting the balance of said fuel; and an optical probe assembly having an optical sensor element protruding into the chamber through a second port opposite said spark gap.

17. A burner assembly for generating a flame, comprising:

a chamber having a fuel inlet for inputting combustible fuel, an air inlet for inputting air to be mixed with said fuel prior to ignition, a first port, and a main burner outlet from said chamber for outputting an air/fuel mixture for combustion;

an ignition assembly including a spark plug with a spark gap section protruding into the chamber through said first port;

a fuel distribution tube connected to the fuel inlet of said chamber and extending interiorly therein for distributing said fuel within said chamber, said distribution tube having a pilot orifice along its length near said spark gap for flowing a pilot portion of said fuel to said spark gap, and said distribution tube having at least one main burner outlet along its length and downstream of said spark gap for outputting a balance of the fuel, whereby the pilot portion of fuel is to maintain a pilot flame for igniting and combusting the balance of said fuel; and a deflector/transport assembly supported over the main burner outlet of said chamber and having a chimney to pass the combusting fuel, said deflector/transport assembly otherwise shielding said main burner outlet to protect the pilot flame.

18. The burner assembly of claim 17, further comprising a flame spreader assembly supported over the chimney of said deflector/transport assembly for channeling the combusting fuel passing therethrough into a flame.

* * * * *